US012389992B1

(12) United States Patent
Wu

(10) Patent No.: US 12,389,992 B1
(45) Date of Patent: Aug. 19, 2025

(54) ANGLE ADJUSTER FOR ADJUSTING UMBRELLA SHAFT

(71) Applicant: Zhaolong Wu, Jiangmen (CN)

(72) Inventor: Zhaolong Wu, Jiangmen (CN)

( * ) Notice: Subject to any disclaimer, the term of this patent is extended or adjusted under 35 U.S.C. 154(b) by 0 days.

(21) Appl. No.: 19/021,274

(22) Filed: Jan. 15, 2025

(30) Foreign Application Priority Data

Sep. 14, 2024 (CN) ..... 202422266710.0

(51) Int. Cl.
*A45B 17/00* (2006.01)

(52) U.S. Cl.
CPC ..... *A45B 17/00* (2013.01)

(58) Field of Classification Search
CPC ..... Y10T 403/32336; Y10T 403/32368; Y10T 403/32361; Y10T 403/32418; F10C 11/10; A46B 5/0083; E05D 11/1007; A45B 2025/003; A45B 2023/0068; A45B 17/00; A47B 2003/004; E04H 12/2284
USPC ..... 16/324, 326; 248/514
See application file for complete search history.

(56) References Cited

U.S. PATENT DOCUMENTS 1,268,734 A * 6/1918 Lay ..... A46B 5/0083 81/177.8
4,614,452 A * 9/1986 Wang ..... F16C 11/10 403/97
5,039,118 A * 8/1991 Huang ..... B62B 9/20 403/96
5,062,179 A * 11/1991 Huang ..... B62B 9/20 403/93
5,123,768 A * 6/1992 Franklin ..... F16C 11/10 403/96
5,265,969 A * 11/1993 Chuang ..... A45B 17/00 16/329
5,358,352 A * 10/1994 Klarhorst ..... H02G 11/00 403/267
5,377,368 A * 1/1995 Cheng ..... A47D 13/063 16/329
5,520,474 A * 5/1996 Liu ..... F16C 11/10 403/92
5,542,151 A * 8/1996 Stranski ..... A47D 13/063 16/329
5,765,958 A * 6/1998 Lan ..... F16C 11/10 403/93
6,405,742 B1 * 6/2002 Driscoll ..... A45B 17/00 135/42
6,629,801 B2 * 10/2003 Cheng ..... B62B 9/20 403/96
6,948,197 B1 * 9/2005 Chen ..... F16C 11/10 5/655
7,140,072 B2 * 11/2006 Leng ..... E06C 1/32 16/326

(Continued)

*Primary Examiner* — Robert Canfield
(74) *Attorney, Agent, or Firm* — Jose Cherson Weissbrot

(57) ABSTRACT

The disclosure provides an angle adjuster for adjusting an umbrella shaft, the angle adjuster including a first connector, a second connector, and a locking assembly, where the first connector has one end configured to be connected to one section of an external umbrella shaft, the second connector has one end rotatably connected to the other end of the first connector, and the other end configured to be connected to the other section of the external umbrella shaft, and the locking assembly is movably connected to the first connector and the second connector and is configured to lock or unlock the first connector from the second connector.

13 Claims, 8 Drawing Sheets

(56) References Cited

U.S. PATENT DOCUMENTS

| | | | | |
|---|---|---|---|---|
| 7,497,225 | B1 * | 3/2009 | Klein, Jr. | A45B 3/00 135/118 |
| 8,006,345 | B1 * | 8/2011 | Bryce | E05D 11/1007 16/285 |
| 8,132,978 | B2 * | 3/2012 | Franklin | F16C 11/10 403/96 |
| 9,534,628 | B1 * | 1/2017 | Wang | F16C 11/10 |
| 10,078,255 | B2 * | 9/2018 | Scott | B25J 1/04 |
| 11,408,192 | B2 * | 8/2022 | Schwiebert | A45B 23/00 |
| 11,732,429 | B2 * | 8/2023 | Reed | A01B 1/022 294/54.5 |
| 11,938,992 | B2 * | 3/2024 | Yuan | B62B 5/064 |
| 12,135,582 | B1 * | 11/2024 | Manthei | G06F 1/1603 |
| 2003/0062709 | A1 * | 4/2003 | Newhard | B62B 7/06 280/47.38 |
| 2003/0077111 | A1 * | 4/2003 | Cheng | B62B 9/20 403/101 |
| 2004/0179891 | A1 * | 9/2004 | Watkins | F16C 11/10 403/96 |
| 2006/0260430 | A1 * | 11/2006 | Gard | F16C 11/10 74/527 |
| 2008/0109994 | A1 * | 5/2008 | Liao | F16C 11/10 16/319 |
| 2011/0297196 | A1 * | 12/2011 | Durante | E05D 11/1007 135/15.1 |
| 2013/0283569 | A1 * | 10/2013 | Lin | E05D 11/1007 16/319 |
| 2016/0015137 | A1 * | 1/2016 | Sasaki | A45B 11/00 135/20.1 |
| 2016/0289997 | A1 * | 10/2016 | Glatz | A45B 23/00 |
| 2022/0127872 | A1 * | 4/2022 | Chen | E04H 12/2223 |

* cited by examiner

ANGLE ADJUSTER FOR ADJUSTING UMBRELLA SHAFT

TECHNICAL FIELD

The disclosure relates to the field of articles for daily use, and in particular to an angle adjuster for adjusting an umbrella shaft.

BACKGROUND ART

At present, an umbrella shaft of a sun umbrella is generally a straight pole, and has a fixed angle. In practical applications, if a user needs to adjust an orientation angle of a cover of the sun umbrella, the sun umbrella needs to be relocated. However, as the angle of solar radiation on the user continuously changes, the user needs to relocate the umbrella frequently to maintain a desirable sunshading effect. The entire process will cause fatigue to the user and also cause symptoms of pain in a joint part of the user.

SUMMARY

An objective of the disclosure is to provide an angle adjuster for adjusting an umbrella shaft, the angle adjuster including: a first connector, a second connector, and a locking assembly, where the first connector has one end configured to be connected to one section of an external umbrella shaft, the second connector has one end rotatably connected to the other end of the first connector, and the other end configured to be connected to the other section of the external umbrella shaft, and the locking assembly is movably connected to the first connector and the second connector and is configured to lock or unlock the first connector from the second connector.

BRIEF DESCRIPTION OF THE DRAWINGS

In order to describe the technical solutions of embodiments of the disclosure more clearly, the drawings required for the embodiments will be briefly introduced below. It should be understood that the following drawings only illustrate some embodiments of the disclosure, and therefore should not be construed as a limitation on the scope of the disclosure. For those of ordinary skill in the art, other relevant drawings can be obtained from these drawings without involving any inventive effort.

Figure 1:
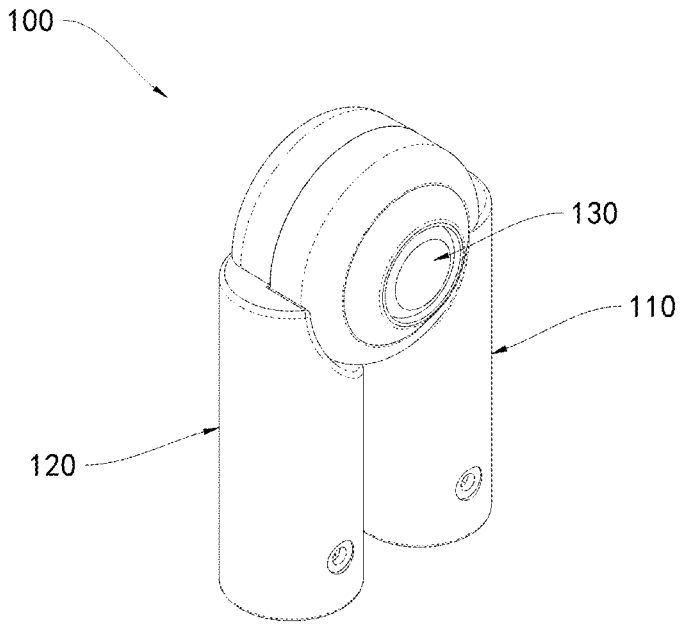
FIG. 1 is a schematic structural diagram of an angle adjuster according to an embodiment of the disclosure.

List of reference signs 100—angle adjuster; 110—first connector; 111—first tooth receptacle; 112—limiting protrusion; 113—first housing; 114—first avoidance recess; 115—bump; 120—second connector; 121—second tooth receptacle; 122—second housing; 123—second avoidance recess; 124—engagement groove; 130—locking assembly; 131—gear disc; 1311—limiting hole; 132—adjusting member; 1321—connecting rod; 1322—button; 1323—limiting catch; 1324—first spring; 1325—reinforcing rib; 140—second spring.

DETAILED DESCRIPTION OF EMBODIMENTS

In order to make the objectives, technical solutions and advantages of embodiments of the disclosure clearer, the technical solutions in the embodiments of the disclosure will be clearly and completely described below with reference to the drawings for the embodiments of the disclosure. Apparently, the described embodiments are some rather than all of the embodiments of the disclosure. In general, the components of the embodiments of the disclosure described and shown in the drawings herein can be arranged and designed in various configurations.

Thus, the following detailed description of the embodiments of the disclosure provided in the drawings is not intended to limit the scope of the disclosure as claimed, and is merely representative of the selected embodiments of the disclosure. Based on the embodiments of the disclosure, all other embodiments obtained by those of ordinary skill in the art without creative efforts fall within the scope of protection of the disclosure.

It should be noted that similar reference signs and letters refer to similar items in the following drawings. Therefore, once a specific item is defined in one of the drawings, it need not be further defined and explained in subsequent drawings.

In the description of the embodiments of the disclosure, it should be noted that the orientation or position relationships indicated by the terms such as "center", "upper", "lower", "left", "right", "vertical", "horizontal", "inner" and "outer" are based on the orientation or position relationships shown in the drawings or are the orientation or position relationships in which a product of the disclosure is customarily placed during use, and are only intended to facilitate descriptions of the disclosure and simplify the descriptions, rather than indicating or implying that the apparatus or element indicated must have a specific orientation or be configured and operated in the specific orientation, and therefore cannot be construed as limiting the disclosure. In addition, the terms "first", "second" and "third" are only intended to distinguish the descriptions and should not be construed as indicating or implying relative importance.

Furthermore, the terms such as "horizontal", "vertical" and "pendulous" do not mean that a component is required to be absolutely horizontal or pendulous, and may be slightly inclined. For example, the term "horizontal" merely indicates that an orientation is more horizontal relative to "vertical", and does not mean that a structure must be completely horizontal, and may be slightly inclined.

In the descriptions of the embodiments of the disclosure, "a plurality of" represents at least 2.

An umbrella according to an embodiment of the disclosure may include an umbrella shaft, a frame connected to the umbrella shaft, and a cover covering the frame. The frame supports the cover, and an angle of the umbrella shaft can be adjusted. In practical applications, an orientation of the cover can be adjusted by adjusting the angle of the umbrella shaft. The umbrella shaft is described in detail below.

An angle adjuster 100 for adjusting an umbrella shaft includes a first connector 110, a second connector 120, and a locking assembly 130, where the first connector 110 has one end configured to be connected to one section of an external umbrella shaft, the second connector 120 has one end rotatably connected to the other end of the first connector 110, the locking assembly 130 is movably connected to the first connector 110 and the second connector 120, and the locking assembly 130 can lock or unlock the first connector 110 from the second connector 120 in different states to enable adjustment of an angle of the external umbrella shaft, and lock one section of the external umbrella shaft and the other section of the external umbrella shaft.

Specifically, when the angle of the umbrella shaft needs to be adjusted by a user, the locking assembly 130 can be operated to unlock the first connector 110 from the second connector 120, such that the first connector 110 can rotate relative to the second connector 120 and an angle between the first connector 110 and the second connector 120 changes, and an angle between one section of the external umbrella shaft and the other section of the external umbrella shaft changes correspondingly, allowing the cover to have different orientations. When the angle between the first connector 110 and the second connector 120 is adjusted to an appropriate angle, the locking assembly 130 can be operated again to lock the first connector 110 and the second connector 120, such that the cover can remain in a preferred sunshade position, and the user does not need to frequently relocate an umbrella during use, thereby alleviating symptoms of pain in a joint part of the user and relieving the fatigue of the user during use.

In an optional embodiment, the umbrella may include a rain umbrella or a sun umbrella.

In an optional embodiment, an angle of rotation between the first connector 110 and the second connector 120 ranges from 0° to 180°. In an example of FIG. 1, in a state as shown in FIG. 1, the angle between the first connector 110 and the second connector 120 is 0°.

In an optional embodiment, the first connector 110 and the second connector 120 are both of a pole-like structure, and an end of the first connector 110 is rotatably connected to an end of the second connector 120, such that when the angle between the first connector 110 and the second connector 120 is 180°, a longer overall length is achieved, which is suitable for more use scenarios.

In an optional embodiment, the locking assembly 130 may be operated by means of pressing, pulling, rotating, etc.

As shown in FIGS. 2-6, a first tooth receptacle 111 is provided at one end of the first connector 110, and a second tooth receptacle 121 is provided at one end of the second connector 120, where the first tooth receptacle 111 is arranged opposite the second tooth receptacle 121. Correspondingly, the locking assembly 130 may include a gear disc 131, and when the gear disc 131 fits with the first tooth receptacle 111 and the second tooth receptacle 121, the gear disc 131 can lock the first connector 110 and the second connector 120 to allow the first connector 110 and the second connector 120 to remain at the current angle.

In practical applications, after the gear disc 131 is disengaged from the first tooth receptacle 111 and/or the second tooth receptacle 121, the first connector 110 and the second connector 120 are unlocked from each other and can be rotated relative to each other. A minimum angle of rotation depends on the number of teeth of the gear disc 131. If the gear disc 131 has more teeth, the angle between adjacent two teeth is smaller, and the minimum angle of rotation between the first connector 110 and the second connector 120 in the unlocked state is smaller. After the first connector 110 and the second connector 120 rotate to an appropriate angle, the gear disc 131 fits with both the first tooth receptacle 111 and the second tooth receptacle 121 again, such that the first connector 110 and the second connector 120 can be locked again.

Figure 2:
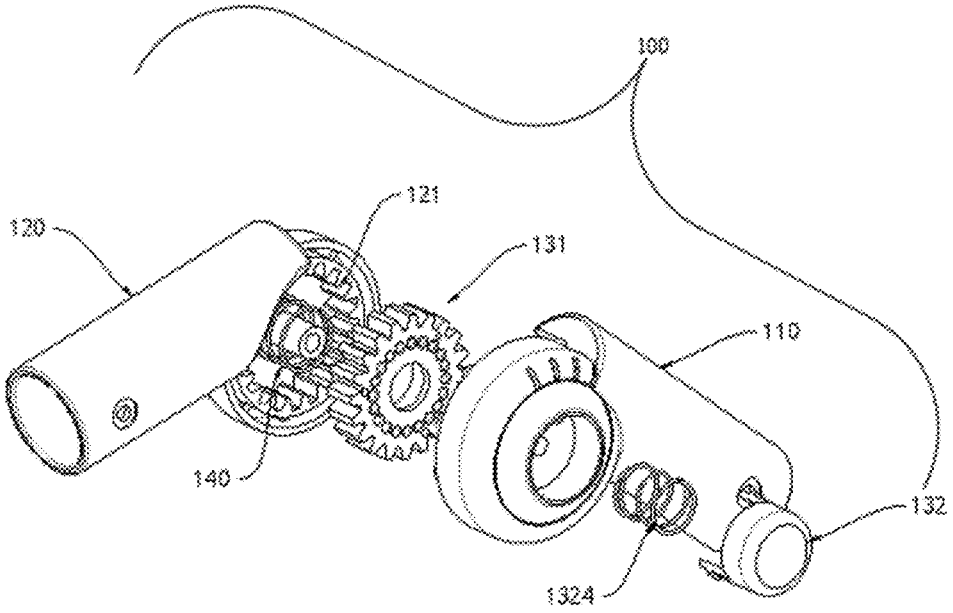
FIG. 2 is a schematic exploded view of an angle adjuster according to an embodiment of the disclosure from a first perspective.
Figure 3:
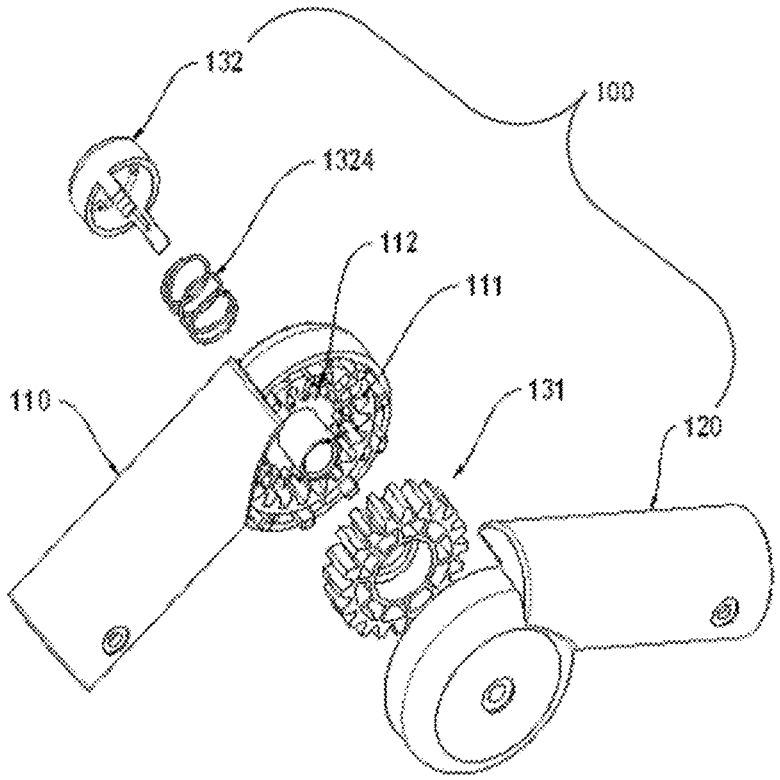
FIG. 3 is a schematic exploded view of an angle adjuster according to an embodiment of the disclosure from a second perspective.
Figure 7:
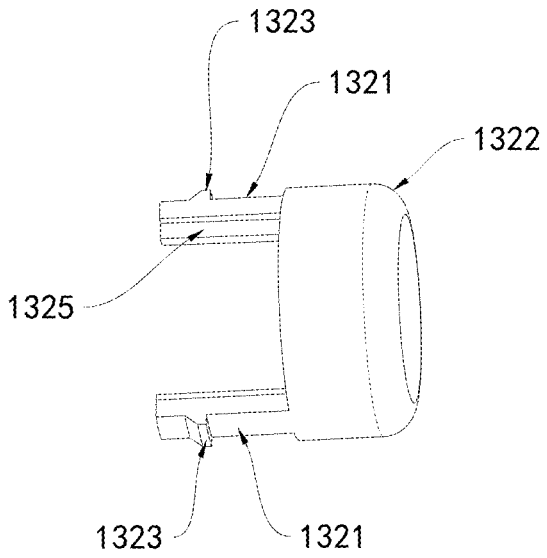
FIG. 7 is a partial schematic diagram of an adjusting member according to an embodiment of the disclosure.

Specifically, FIG. 7 is a partial schematic diagram of an adjusting member according to an embodiment of the disclosure. As shown in FIGS. 2, 3 and 7, the locking assembly 130 may further include an adjusting member 132. A portion of the adjusting member 132 is located outside the first connector 110, and the rest of the adjusting member 132 passes through the first connector 110 and is connected to the gear disc 131. In this way, when the angle of the umbrella shaft needs to be adjusted by the user, the portion of the adjusting member 132 outside the first connector 110 can be operated, and the adjusting member 132 can cause the gear disc 131 to be disengaged from the first tooth receptacle 111 and the second tooth receptacle 121, so as to unlock the first connector 110 from the second connector 120. Similarly, when the angle between the first connector 110 and the second connector 120 is adjusted to an appropriate angle, the portion of the adjusting member 132 outside the first connector 110 can be adjusted by the user again (or the adjusting member 132 is automatically reset, as will be described hereinafter), and the adjusting member can cause the gear disc 131 to fit with the first tooth receptacle 111 and the second tooth receptacle 121, so as to lock the first connector 110 and the second connector 120.

It should be understood that a portion of the adjusting member 132 being located outside the first connector 110 can facilitate operation of the user, improving the efficiency of adjustment of the angle between the first connector 110 and the second connector 120.

As shown in FIG. 7, the adjusting member 132 may include a connecting rod 1321 and a button 1322. One end of the connecting rod 1321 passes through the first connector 110 and is connected to the gear disc 131. The button 1322 is connected to an end of the connecting rod 1321 away from the gear disc 131, and the button 1322 is located outside the first connector 110. It should be understood that the button 1322 can be conveniently pressed by an operator, thereby achieving an easy and quick operation.

As shown in FIG. 7, an end of the connecting rod 1321 away from the button 1322 is of a flat-tip structure, such that a contact surface of abutment between the connecting rod 1321 and the gear disc 131 can be increased, thereby improving the stability of abutment.

As shown in FIG. 7, a reinforcing rib 1325 is further provided on an inner side of the connecting rod 1321, and the reinforcing rib 1325 can enhance the structural strength of the connecting rod 1321 and reduce the possibility of the connecting rod 1321 being bent or broken.

In an optional embodiment, an end of the reinforcing rib 1325 away from the button 1322 is flush with the end of the connecting rod 1321 away from the button 1322, such that the reinforcing rib 1325 can enhance the structural strength of the connecting rod 1321 over the entire length of the connecting rod 1321, thereby allowing different parts of the connecting rod 1321 to be less likely to be bent or broken.

Figure 8:
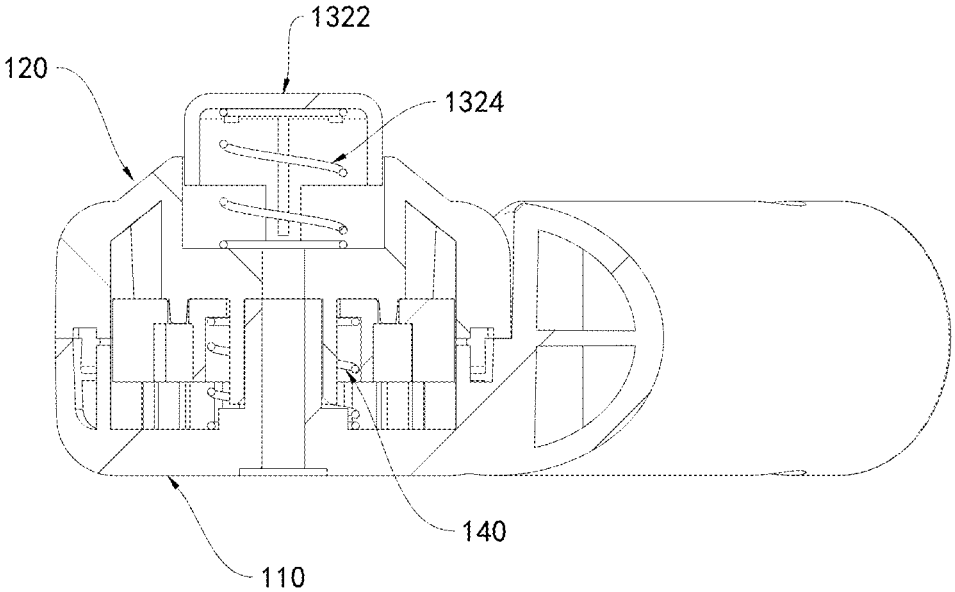
FIG. 8 is a cross-sectional view of an angle adjuster according to an embodiment of the disclosure.

FIG. 8 is a cross-sectional view of an angle adjuster according to an embodiment of the disclosure. As shown in FIGS. 2, 3 and 8, the adjusting member 132 may further include a first spring 1324, where the first spring 1324 is arranged between the button 1322 and the first connector 110, and the first spring 1324 has two opposite ends connected to the button 1322 and the first connector 110, respectively.

In practical applications, when the button 1322 is pressed by the user, the button 1322 pushes, via the connecting rod 1321, the gear disc 131 to be disengaged from the first tooth receptacle 111, such that the first connector 110 can rotate relative to the second connector 120, and the first spring 1324 is in a compressed state. After the first connector 110 is rotated to an appropriate angle relative to the second connector 120, the button 1322 is released by the user, the first spring 1324, under the action of a restoring force, causes the connecting rod 1321 to reset, and the connecting rod 1321 pulls the gear disc 131 to re-fit with the first tooth receptacle 111. In this case, the gear disc 131 fits with both the first tooth receptacle 111 and the second tooth receptacle 121 again, such that the first connector 110 and the second connector 120 are in a locked state.

It should be understood that the structure of the first spring 1324, the button 1322 and the connecting rod 1321 used in the embodiment of the disclosure has a simpler overall structure, requires less parts, may be manufactured and maintained at low costs, and has an improved overall stability while facilitating the user quickly locking and unlocking the first connector 110 from the second connector 120.

As shown in FIGS. 2, 3, 6 and 8, the angle adjuster 100 may further include a second spring 140, where the second spring 140 is nested inside the second connector 120, one end of the second spring 140 abuts against an inner wall of the second connector 120, and the other end of the second spring 140 abuts against the gear disc 131.

In practical applications, when the button 1322 is pressed by the user, the button 1322 pushes, via the connecting rod 1321, the gear disc 131 to be disengaged from the first tooth receptacle 111, such that the first connector 110 can rotate relative to the second connector 120, and the first spring 1324 is in a compressed state. In this case, the gear disc 131 applies a pressure on the second spring 140, and the second spring 140 is also in a compressed state. After the first connector 110 is rotated to an appropriate angle relative to the second connector 120, the button 1322 is released by the user, the first spring 1324, under the action of a restoring force, causes the connecting rod 1321 to reset, and the connecting rod 1321 pulls the gear disc 131 to re-fit with the first tooth receptacle 111. During this process, the second spring 140, under the action of a restoring force, can provide an ejection effect on the gear disc 131, such that the second spring 140 can assist the connecting rod 1321 to eject the gear disc 131 into the first tooth receptacle 111. In this case, the gear disc 131 fits with both the first tooth receptacle 111 and the second tooth receptacle 121 again, such that the first connector 110 and the second connector 120 are in a locked state.

It should be noted that compared with the solution in which only the first spring 1324 is provided, the solution in which both the first spring 1324 and the second spring 140 which cooperate with each other are used can reduce the occurrence of the button 1322 getting stuck and failing to pop out.

As shown in FIG. 7, two connecting rods 1321 are provided, and the two connecting rods 1321 are symmetrically arranged with respect to an axis of rotation of the first connector 110 and the second connector 120. In this way, after the button 1322 is pressed by the user, the two connecting rods 1321 can both push the gear disc 131 to be disengaged from the first engagement groove, such that the gear disc 131 is less likely to tilt and get stuck during the pushing process, thereby improving the overall structural stability.

As shown in FIG. 7, a limiting catch 1323 is provided on the connecting rod 1321, and after the connecting rod 1321 passes through the first connector 110, the limiting catch 1323 can reversely abut against the first connector 110 to limiting the connecting rod 1321 from disengagement from the first connector 110.

Figure 4:
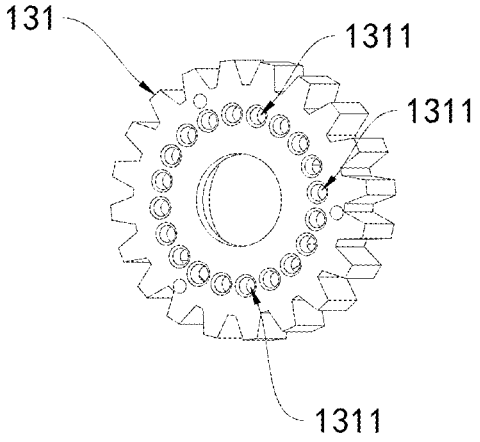
FIG. 4 is a schematic structural diagram of a gear disc according to an embodiment of the disclosure.

As shown in FIGS. 3 and 4, a limiting protrusion 112 is provided on the first tooth receptacle 111, a limiting hole 1311 is provided in the gear disc 131, and when the first connector 110 and the second connector 120 are in the locked state, the limiting protrusion 112 fits with the limiting hole 1311, which enables the gear disc 131 to be fixed in the first tooth receptacle 111 and be less likely to be disengaged from the first tooth receptacle 111, and which can assist the gear disc 131 to provide an improved locking effect, such that the first connector 110 and the second connector 120 are less likely to swing from side to side, thereby achieving a more stable overall structure.

It should be understood that during the unlocking process, the adjusting member 132 causes the gear disc 131 to be disengaged from the first engagement groove, and the limiting protrusion 112 is then disengaged from the limiting hole 1311, which causes the limiting protrusion 112 no longer limits the gear disc 131, such that the first connector 110 and the second connector 120 are in the unlocked state, thereby facilitating rotating the first connector 110 to adjust the angle between the first connector 110 and the second connector 120.

As shown in FIGS. 3 and 4, a plurality of limiting protrusions 112 are provided. The plurality of limiting protrusions 112 are distributed at intervals in a circumferential direction of the first tooth receptacle 111. Correspondingly, a plurality of limiting holes 1311 are provided, and the plurality of limiting holes 1311 are distributed at intervals in a circumferential direction of the gear disc 131. It should be understood that the plurality of limiting protrusions 112 and the plurality of limiting holes 1311 fit with each other, such that the stability of assembly of the gear disc 131 in the first tooth receptacle 111 can be improved, and it is less likely for the gear disc 131 to be disengaged from the first tooth receptacle 111 in the locked state.

In an optional embodiment, some of the limiting holes 1311 fit with the limiting protrusions 112, and the rest of the limiting holes 1311 may be configured for passage of the connecting rod 1321 described above.

As shown in FIGS. 1-6, a first housing 113 and a first avoidance recess 114 are provided at one end of the first connector 110, the first tooth receptacle 111 described above is arranged in the first housing 113, a second housing 122 and a second avoidance recess 123 are provided at one end of the second connector 120, and the second tooth receptacle 121 described above is arranged in the second housing 122.

In practical applications, the first housing 113 matches the second housing 122, such that an inner cavity for receiving the gear disc 131 can be formed. The connecting rod 1321 described above passes through the first housing 113, enters the inner cavity, and is then connected to the gear disc 131.

It should be noted that when the first housing 113 matches the second housing 122, the first housing 113 is received in the second avoidance recess 123, and the second housing 122 is received in the first avoidance recess 114. In this way, the space occupied by the first housing 113 and the second housing 122 in a radial direction of the umbrella shaft can be reduced, thereby improving the utilization rate of the radial space of the umbrella shaft.

In an optional embodiment, the first housing 113 and the second housing 122 are detachably connected to each other by means of a snap-fit structure, such that the gear disc 131 can be easily replaced and maintained.

Figure 5:
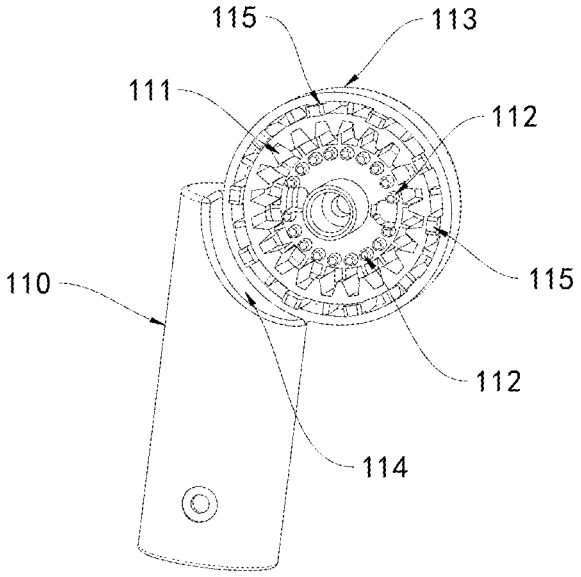
FIG. 5 is a schematic structural diagram of a first connector according to an embodiment of the disclosure.
Figure 6:
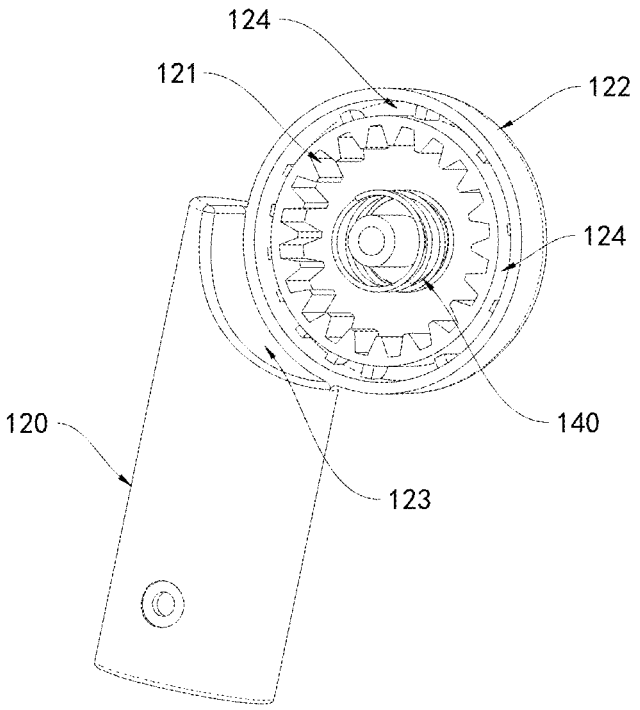
FIG. 6 is a schematic structural diagram of a second connector according to an embodiment of the disclosure.

As shown in FIGS. 5 and 6, a bump 115 is provided between an inner wall of the first housing 113 and an outer wall of the first tooth receptacle 111, an engagement groove 124 is provided between an inner wall of the second housing 122 and an outer wall of the second tooth receptacle 121, and the bump 115 is engaged with the engagement groove 124, such that the first housing 113 and the second housing 122 can be better joined, thereby improving the tightness of the two, and achieving a greater bearing capacity of the first housing 113 and the second housing 122.

In an optional embodiment, a plurality of bumps 115 are provided, a plurality of engagement grooves 124 are provided, and the plurality of bumps 115 engage with the plurality of engagement grooves 124 in one-to-one correspondence. In this way, after the first housing 113 and the second housing 122 rotate relative to each other, the plurality of bumps 115 engage with the plurality of engagement grooves 124 in a one-to-one correspondence to ensure that assembly errors are less likely to occur after the rotation of the first housing 113 and the second housing 122.

The above descriptions are merely preferred embodiments of the disclosure, and are not intended to limit the disclosure. For those skilled in the art, various modifications and variations may be made to the disclosure. Any modifications, equivalent substitutions, improvements, and the like made within the spirit and principle of the disclosure should fall within the scope of protection of the disclosure.

The invention claimed is:

1. An angle adjuster for adjusting an umbrella shaft, the angle adjuster comprising:

a first connector having a first end and a second end, the first end of the first connector is provided with a first tooth receptacle, and the first tooth receptacle is provided with a limiting protrusion, wherein the first end of the first connector is coupled to a first section of the umbrella shaft;

a second connector having a first end and a second end, the first end of the second connector is provided with a second tooth receptacle, wherein the first end of the second connector is rotatably coupled to the second end of the first connector, and the second end of the second connector is connected to a second section of the umbrella shaft; and a locking assembly movably connected to the first connector and second connector, wherein the locking assembly comprises a gear disc having a limiting hole, the gear disc is fitted with the first tooth receptacle and the second tooth receptacle to lock the first connector and the second connector, when the first connector and the second connector are in a locked state, the limiting protrusion fits with the limiting hole and when the first connector and the second connector are in an unlocked state, the limiting protrusion is disengaged from the limiting hole.

2. The angle adjuster according to claim 1, wherein the locking assembly further comprises:

an adjusting member, a portion of the adjusting member being located outside the first connector, and the rest of the adjusting member passing through the first connector and being connected to the gear disc;

wherein the adjusting member is configured to cause the gear disc to be disengaged from the first tooth receptacle and the second tooth receptacle, so as to unlock the first connector from the second connector, and the adjusting member is configured to cause the gear disc to fit with the first receptacle and the second tooth receptacle, so as to lock the first connector and the second connector.

3. The angle adjuster according to claim 2, wherein the adjusting member comprises:

a connecting rod, one end of the connecting rod passing through the first connector and being connected to the gear disc; and a button connected to an end of the connecting rod away from the gear disc, the button being located outside the first connector.

4. The angle adjuster according to claim 3, wherein the adjusting member further comprises:

a first spring arranged between the button and the first connector, the first spring having two opposite ends connected to the button and the first connector, respectively.

5. The angle adjuster according to claim 3, wherein two connecting rods are provided, and the two connecting rods are symmetrically arranged with respect to an axis of rotation of the first connector and the second connector.

6. The angle adjuster according to claim 3, wherein an end of the connecting rod away from the button is of a flat-tip structure.

7. The angle adjuster according to claim 3, wherein a reinforcing rib is provided on an inner side of the connecting rod.

8. The angle adjuster according to claim 7, wherein an end of the reinforcing rib away from the button is flush with an end of the connecting rod away from the button.

9. The angle adjuster according to claim 1, wherein the angle adjuster further comprises:

a second spring nested inside the second connector, the second spring having one end abutting against an inner wall of the second connector, and the other end abutting against the gear disc.

10. The angle adjuster according to claim 1, wherein a plurality of limiting protrusions are provided, the plurality of limiting protrusions being distributed at intervals in a circumferential direction of the first tooth receptacle, and a plurality of limiting holes are provided, the plurality of limiting holes being distributed at intervals in a circumferential direction of the gear disc.

11. The angle adjuster according to claim 1, wherein a first housing and a first avoidance recess are provided at the first end of the first connector, the first tooth receptacle being arranged in the first housing, a second housing and a second avoidance recess are provided at the first end of the second connector, the second tooth receptacle being arranged in the second housing, wherein the first housing matches with the second housing to form an inner cavity for receiving the gear disc, the first housing is received in the second avoidance recess, and the second housing is received in the first avoidance recess.

12. The angle adjuster according to claim 11, wherein a bump is provided between an inner wall of the first housing and an outer wall of the first tooth receptacle, an engagement groove is provided between an inner wall of the second housing and an outer wall of the second tooth receptacle, the bump engaging with the engagement groove.

13. The angle adjuster according to claim 12, wherein a plurality of bumps are provided, a plurality of engagement grooves are provided, and the plurality of bumps engage with the plurality of engagement grooves in a one-to-one correspondence.

* * * * *